United States Patent [19]

Hallerbäck et al.

[11] 4,225,292

[45] Sep. 30, 1980

[54] LIQUID COOLED PUMP MOTOR UNIT

[75] Inventors: Stig L. Hallerbäck, Västra Frölunda, Leif Lachonius, Swite, both of Sweden

[73] Assignee: Aktiebolaget SKF, Goteborg, Sweden

[21] Appl. No.: 862,933

[22] Filed: Dec. 21, 1977

[30] Foreign Application Priority Data

Feb. 2, 1977 [SE] Sweden ..... 7701002

[51] Int. Cl.[3] ..... F04B 39/06

[52] U.S. Cl. ..... 417/367; 417/370

[58] Field of Search ..... 417/366, 369, 370, 371, 417/367

[56] References Cited

U.S. PATENT DOCUMENTS

| | | | |
|---|---|---|---|
| 2,845,871 | 8/1958 | Compton | 417/366 X |
| 2,925,041 | 2/1960 | Sigmund | 417/370 X |
| 3,220,350 | 11/1965 | White | 417/370 |
| 3,723,028 | 3/1973 | Bottoms et al. | 415/72 X |

FOREIGN PATENT DOCUMENTS

| | | | |
|---|---|---|---|
| 2529399 | 1/1977 | Fed. Rep. of Germany | 417/366 |

*Primary Examiner*—Richard E. Gluck

*Attorney, Agent, or Firm*—Eugene E. Renz, Jr.

[57] ABSTRACT

A pump motor assembly comprising a stator with windings, a rotor shaft mounting a rotor in said stator, a diffuser housing arranged adjacent said stator and enclosing at least partly the stator windings, means defining a flow channel in said diffuser housing for circulation of a medium from an inlet to an outlet in said diffuser housing, and disposed in said flow channel for circulating the cooling medium therethrough over the stator windings to cool the same.

4 Claims, 2 Drawing Figures

LIQUID COOLED PUMP MOTOR UNIT

BACKGROUND OF THE INVENTION

The present invention refers to a pump motor unit comprising an electric driven motor, which is cooled by means of a liquid.

Different pump motor units for propulsion of a liquid through different devices are earlier known. These pump units vary in structure dependent on the liquid to be pumped and where the unit is mounted. Pump motor units of this type are used in a wide variety of applications and a particularly important one is in washing machines or the like used in the home, such as clothes and dishwashers. In these applications, a rinsing fluid is pumped through the machine and usually a centrifugal pump driven by an electric motor is used to effect the circulation of the rinsing liquid.

The present invention refers primarily to domestic machines and it is described in connection to such machines but it is in no way limited to this type of machine.

A common problem in, for instance dish washing machines is the small space available for the pump motor unit. This unit which has to pump the wash liquor through the machine and to rinse the dish is usually arranged at the lower side of the machine near the floor. The outer dimensions of the machine are generally determined by standardization specifications and an increase of the active volume of the machine may then only be made on account of the space for the pump motor unit. It is therefore a desire to make this unit as small as possible.

The electric motor of the pump motor unit of this type is generally cooled by jets of air caused by a cooling blower built into the motor. The part of the motor situated furthest away from the dish container is thereby generally exposed to efficient cooling, whereas the portion situated nearest to the dish container is poorly cooled due to the high temperature of the dish drum and the very small air space at that location. The problem can be reduced by provision of casings which deflect the air jets in suitable manner. During all conditions it is necessary to have such a rapid air flow as possible. This in turn can cause waste water on the floor below the motor to be drawn into the motor causing a short circuit. It is therefore a further desire to be able to eliminate the blower system for air cooling of the motor.

SUMMARY OF THE INVENTION

The above mentioned problems have been solved according to the present invention and it has been provided an electric pump motor unit characterized by novel features of construction and arrangement including an electric motor, a pump housing having inlet and outlet ports and a pump wheel arranged on the rotor shaft of the electric motor which unit is characterized thereby that the diffusor part of the pump housing is arranged immediately adjacent the stator portion of the electric motor in a manner at least partly to enclose the stator windings to allow the pump medium to flow immediately adjacent these and to cool them.

It is according to the invention advantageous that the stator and the diffusor part are made in one piece.

It is according to the invention furthermore most suitable that the stator is embedded in plastic and that it is enclosed by a plastic casing or the like, primarily around the winding coils.

If a plastic winding casing is used it is suitable to make this casing and the diffusor part in one piece.

In order to bring about a liquid cooling of the space inside the windings it is possible to arrange openings in the pump wheel in such a manner that the pump medium can flow therethrough and into said space.

In pump units of the type described above, wherein the shaft of the pump wheel engages through an opening in the wall of the pump housing, there is always a certain amount of leakage. However, in accordance with the present invention drainage channels are provided which extend from the space around the shaft between the pump wheel seal and the adjacent bearing which communicate with the ambient atmosphere outside of the unit. These drainage channels can preferably be made in the cover which constitutes the winding casing and the diffusor.

In order to facilitate a certain air circulation in the interior of the motor it is according to the invention provided airing channels in the above mentioned cover, which channels extend from the interior of the motor to the drainage space which communicates with the surroundings. Since plastic often has a certain permeability to moisture, a moisture trap may be provided in accordance with the present invention which is in the form of a metal foil disposed on the inner side of the winding casing facing the windings.

BRIEF DESCRIPTION OF THE DRAWING

The invention will hereinafter be further described with reference to the accompanying drawings, wherein.

DESCRIPTION OF THE PREFERRED EMBODIMENT

Figure 1:
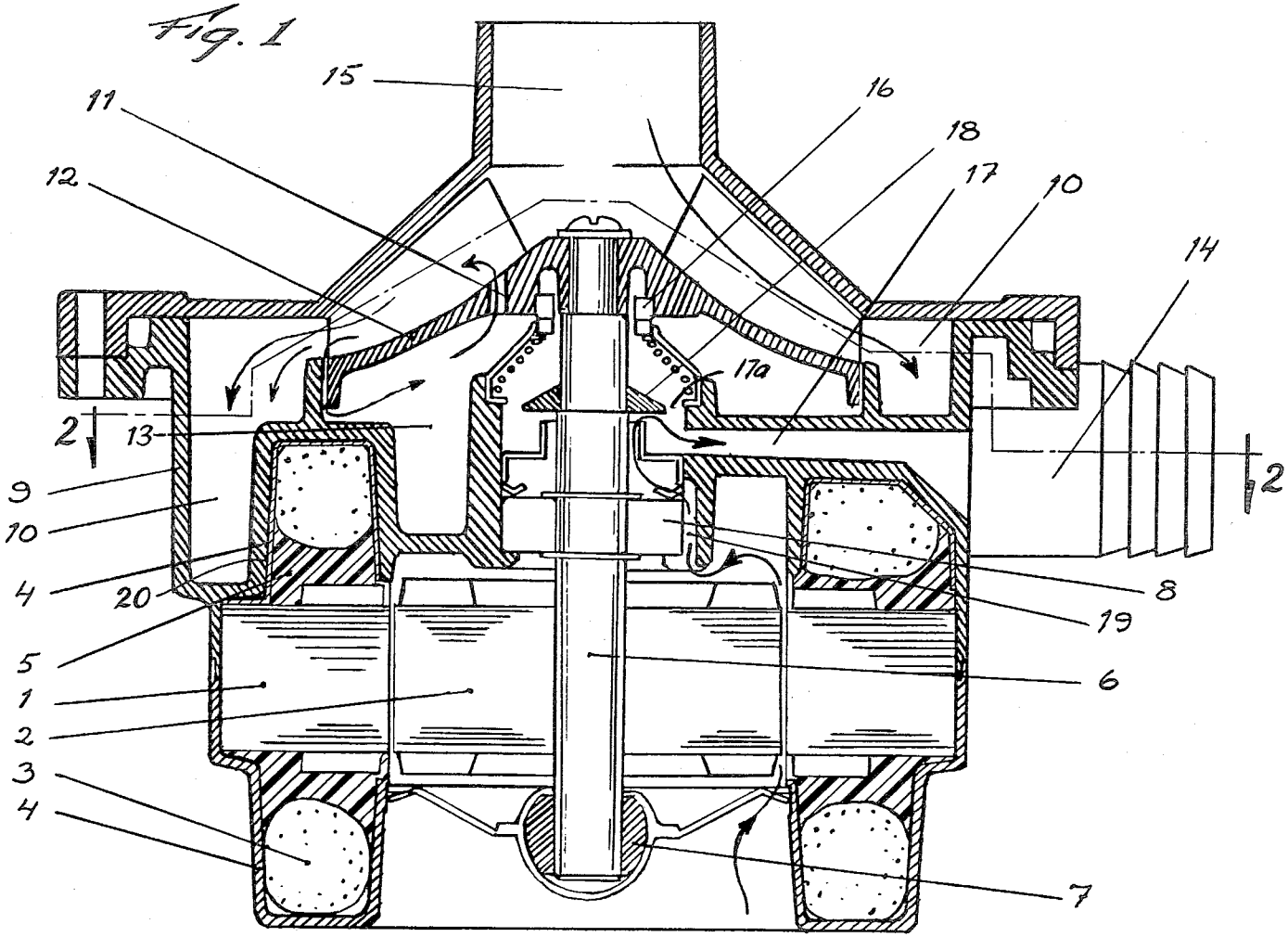
FIG. 1 is a vertical sectional view through a pump motor assembly in accordance with the present invention.
Figure 2:
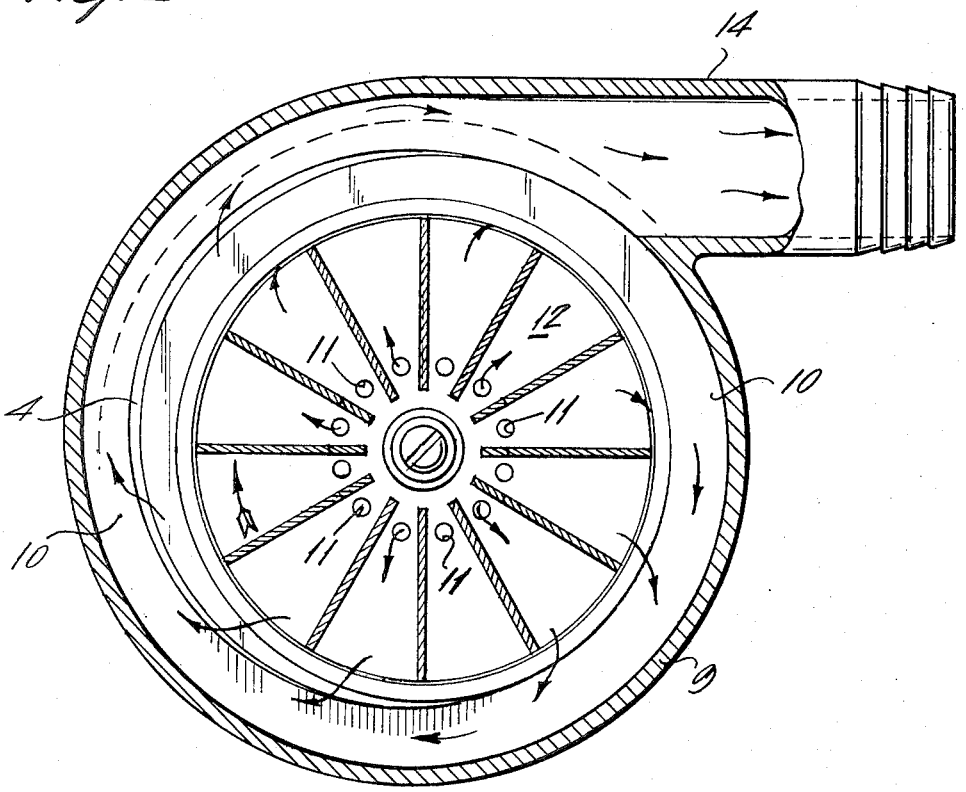
FIG. 2 is a transverse sectional view thereof taken on lines 2—2 of FIG. 1.

In the figure is shown an electric motor with a stator 1, a rotor 2 and windings 3. The winding coils are enclosed in winding casings 4 and they are embedded in a thermoset 5. The rotor 2 with its shaft 6 is supported in a sliding bearing 7 and in a rolling bearins 8.

The diffusor part 9 of the pump housing is as can be seen made integral with the winding casing 4. The helical liquid channel 10 for the pump medium is arranged immediately adjacent the winding coils. A most efficient cooling of the windings is thereby obtained. A dish washing machine motor usually has a liquid temperature of about 70° C. and the temperature of the windings will therefore generally not exceed this temperature. Due to the good heat transferring ability of the copper windings the heat will be transferred from the entire winding to its upper portion, which is cooled by liquid. The pump wheel 12 is provided with openings 11 to allow liquid to flow out from the spaces 13 as indicated by the arrows and by this arrangement the windings are also cooled by the liquid at their inner side. The outlet 14 for the pump medium is arranged in the diffusor part of the pump housing, whereas the inlet 15 is located in the cover portion.

For sealing off the passage of the shaft through the pump housing a flat seal 16 has been used in conventional manner. These seals occasionally leak and accordingly a drainage channel 17 is arranged in the cover to transport any leakage from the seal 16. This channel extends from the space 17$^a$ between the flat seal and the nearest bearing 8 and into the open. A flinger ring 18 has been fitted to the shaft in order to prevent liquid from flowing down towards the bearing. A flinger ring such as the one shown requires a vertical shaft. In some cases there is however used horizontal shafts. In such a case it is possible to form a seal by means of a V-ring or the like, which is fitted at the location of the flinger ring 18 shown.

As can be seen from the drawing there is no blower for air cooling in the embodiment shown. A certain air circulation can however appear in the interior of the motor if air channels 19 are arranged in the cover around the rolling bearing. These channels must communicate with the drainage space. Escape of air due to natural convection and due to the rotation of the shaft will then arise and this flow will follow the path shown by the arrow.

The casing 4 around the winding coils is preferably made of plastic. Some plastic types can however be somewhat permeable to moisture and it is therefore desirous to arrange a moisture trap at the internal side of the casing facing the winding coils.

This moisture trap can preferably be constituted of a metal foil 20 or the like. For good dissipation of the heat from the windings to the cooling liquid, the thermoset material is preferably flowed to each side of the metal foil during the molding operation.

An advantage achieved by allowing the dish washing liquid to cool the electric motor, besides the fact that a very compact unit with no need of air cooling is obtained, is the additional advantage that the waste heat from the motor can be recovered in the dish washing liquid whereby less energy is required for heating this liquid. By eliminating the blower the risk that waste water can be sucked up into the electric motor is also eliminated. As the pump housing and the motor are made in one piece is furthermore the advantage obtained that fewer loose parts have to be assembled.

The invention is not limited to the embodiment shown in the drawing, but can be modified in several ways within the scope of the appended claims.

We claim:

1. A pump motor assembly comprising a stator (1) with windings (3), said stator being imbedded in a plastic molding material (5) and surrounded by a stator casing (4), a rotor shaft (6) mounting a rotor (2) in a rotor chamber in said stator, a diffuser housing (9) arranged adjacent said stator and enclosing at least partly the stator windings, said stator casing (4) and diffuser housing (9) being an integral one-piece assembly, means defining a flow channel (10) in said diffuser housing for circulation of a cooling medium from an inlet (15) to an outlet (14) in said diffuser housing, a pump wheel (12) disposed in said flow channel mounted on said rotor shaft to effect circulation of the cooling medium through said flow channel (10) over the stator windings to cool the same, means defining openings (11) in said pump wheel allowing cooling medium to flow through the pump wheel and out from space (13) interiorly of the windings (3), said rotor shaft rotatably journalled in the casing on bearing means (8) and including a space (17$^a$) around the rotor shaft (6) between the pump wheel and the bearing means and at least one drainage channel (17) arranged to extend from said space (17$^a$) to exteriorly of the pump motor assembly.

2. A pump motor assembly as claimed in claim 1 wherein the drainage channel is arranged in a cover member defined by the winding casing and diffuser housing.

3. A pump motor assembly as claimed in claim 2 including at least one air channel extending from interiorly of the motor to said drainage channel and arranged in said cover to effect air circulation through the rotor chamber.

4. A pump motor assembly as claimed in claim 1 including at least one air channel (19) extending from interiorly of the motor to the drainage channel 17 to effect an air circulation through the rotor chamber.

* * * * *